US008434728B2

(12) United States Patent
Kempf

(10) Patent No.: US 8,434,728 B2
(45) Date of Patent: May 7, 2013

(54) I-BEAM TRACK WITH A SEPARATE ATTACHMENT PORTION

(75) Inventor: James Kempf, Wallkill, NY (US)

(73) Assignee: Production Resource Group, LLC, New Windsor, NY (US)

( * ) Notice: Subject to any disclaimer, the term of this patent is extended or adjusted under 35 U.S.C. 154(b) by 438 days.

(21) Appl. No.: 12/749,352

(22) Filed: Mar. 29, 2010

(65) Prior Publication Data

US 2010/0242562 A1 Sep. 30, 2010

Related U.S. Application Data

(60) Provisional application No. 61/165,435, filed on Mar. 31, 2009.

(51) Int. Cl.
*A47H 1/10* (2006.01)

(52) U.S. Cl.
USPC ..... 248/317; 248/343

(58) Field of Classification Search ..... 248/317, 248/318, 343; 72/257
See application file for complete search history.

(56) References Cited

U.S. PATENT DOCUMENTS

| | | | | |
|---|---|---|---|---|
| 2,595,182 | A * | 4/1952 | Weingarten | 104/93 |
| 3,784,144 | A * | 1/1974 | Ollinger et al. | 248/317 |
| 7,276,666 | B2 * | 10/2007 | Zeuner et al. | 174/154 |
| 8,061,672 | B1 * | 11/2011 | Kaufman | 248/317 |
| 8,201,781 | B2 * | 6/2012 | Parsons | 248/125.1 |
| 2006/0138288 | A1 * | 6/2006 | Parsons | 248/125.7 |
| 2010/0037533 | A1 * | 2/2010 | Anderson | 52/39 |

* cited by examiner

*Primary Examiner* — Ramon Ramirez
(74) *Attorney, Agent, or Firm* — Law Office of Scott C. Harris, Inc.

(57) ABSTRACT

A dual sided extrusion, where one side has a different shape than the other side, and the extrusion is intended to be used in different orientations depending on the application.

8 Claims, 2 Drawing Sheets

I-BEAM TRACK WITH A SEPARATE ATTACHMENT PORTION

This application claims priority from provisional application No. 61/165,435, filed Mar. 31, 2009, the entire contents of which are herewith incorporated by reference.

BACKGROUND

In stage environments, it is often desirable to hang the items from the ceiling. For example, different winches and other items may be hung from support structures on a ceiling. A first winch for example may roll along a track in order to move to move the things it holds, e.g, scenery, to different places.

Different support structures may be used including a I beam, and others.

Devices can also be mounted to move along tracks in the floor, for example a knife edge or a so-called "dog". For example, a track may be formed in the floor, where scenery can move along and be supported by the track in the floor.

Different structural elements are often used for different purposes. For example, a rolling winch may be attached to an I-beam connection on the ceiling. Moving scenery may be attached to moving elements on the floor. This necessitates, however, that workers setting up the stage have adequate stock of many different supports.

SUMMARY

The present application refers to a track extrusion with two different structural formats and which mounts in two different directions depending on the desired format.

In an embodiment, both sides of an extrusion form either or both of load connection sides or attachment sides.

Another embodiment describes a special clamp for holding multiple different forms.

DETAILED DESCRIPTION

Figure 1:
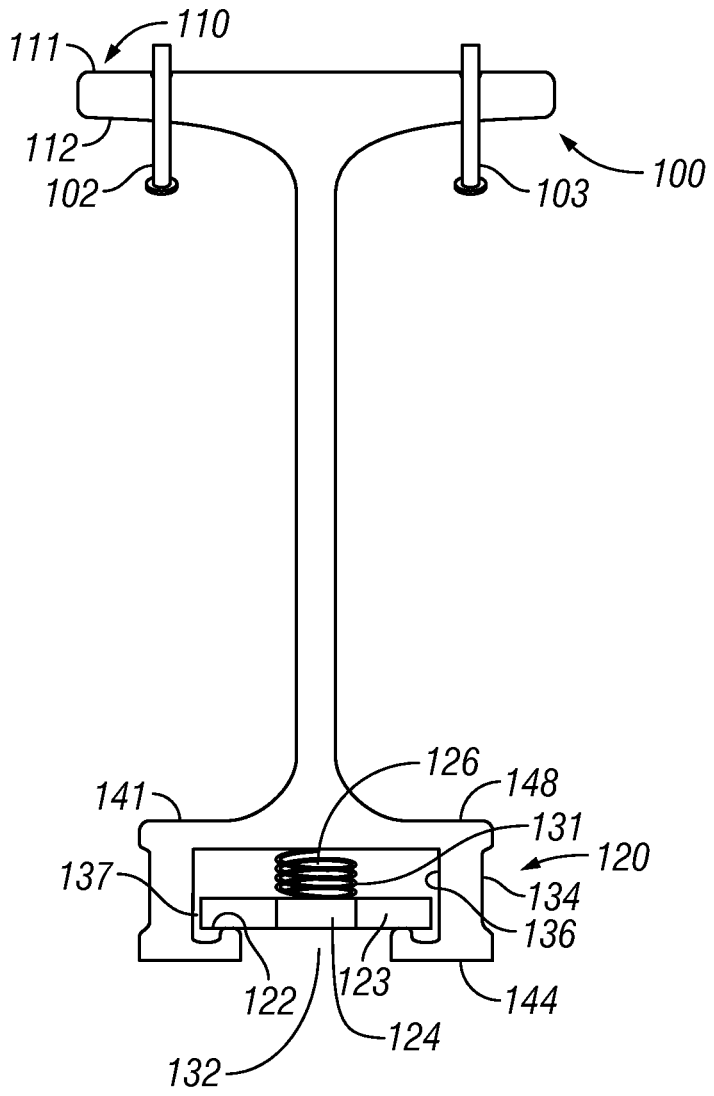
FIG. 1 shows a track extrusion according to an embodiment.

FIG. 1 shows a cross-section of a double-sided track element 100. It should be understood from the cross-section in FIG. 1 that the track extends along an elongated axis. The track may be fabricated in pre-made lengths, e.g., 8 foot, 12 foot, 16 foot, and other lengths. Most or all of the track has the cross sectional format shown in FIG. 1.

The track extrusion 100 has a first I-beam side 110, and a second cavity based side 120. In an embodiment the track extrusion can be used with either side configured to hold items such as stage scenery. In embodiments, both sides are also configured to be connected to a structural support, e.g., a truss or ceiling support.

The first side 110 is an I-beam style side. In this embodiment, the track may be connected for example to a ceiling. Then, the surface 112 forms an I-beam shaped surface. Devices can be attached to and slide along the surfaces 112, in the same way that they would slide all along the surface of an I-beam.

The second side 120 can be used for example by connections made on the first side 110. In this embodiment, screws or bolts 102, 103 can be connected through the I-beam side to hold it into place to a support. As an alternative, the second side 120 can be used for support by connecting for example to a connection surface 134 on either side of the second side. The second side forms a cup shaped part, which includes a cavity 131. Inside the cavity, there are coupled portions such as 122 which may allow the device to be used with the opening 132 of the cavity facing downward, allowing devices to roll along the surface 122. In addition, however, this can be used as a part in for example a stage floor, where the opening 132 faces up, and this forms a track in the stage. In this way, the same extrusion device 100 can be used both for overhead hanging, and also for floor mounted devices.

The cavity portion forms a cavity 131 which forms a captive portion therein. The captive portion is formed by the distance between the sidewalls 136, 137 being larger than the opening 132 to the cavity. The opening 132 is formed by inwardly facing elements which face inward and form two portions which extend inward relative to the two sides of the cavity. Therefore, when a device is placed within the cavity 131, and is larger than the opening 132, it becomes captive within the cavity and cannot be removed from the cavity except at ends of the extrusion.

In an embodiment, a unistrut style nut 123 is held within the cavity. The unistrut nut 123 may include substantially parallel side surfaces which press against inner surfaces 136, 137 of the inner surface of the cavity. The nut 123 includes a central threaded portion 124, and a spring 126 pressing the nut against the surfaces 122. The sides of the nut are held against the inner surfaces 136 so that it cannot rotate.

In addition, narrower surfaces can be formed as 141, so that a device can ride on those narrow surfaces 141. The distance between the narrower surfaces 141 for example is less than the distance between the surfaces 112 of the I-beam.

Therefore, this device 100 takes the place of multiple different tracks. This device also can, for the first time, be used in different locations and orientations, and take the place of many different kinds of support. The single part can be mounted overhead on a stage. The part can also be mounted inside a floor. Therefore, this device takes the place of two different tracks.

Also, by mounting in one direction, a mounting may allow connection across the outer edge surfaces 122. By mounting in another direction, the same device can be mounted on inner surfaces 122.

Figure 2:
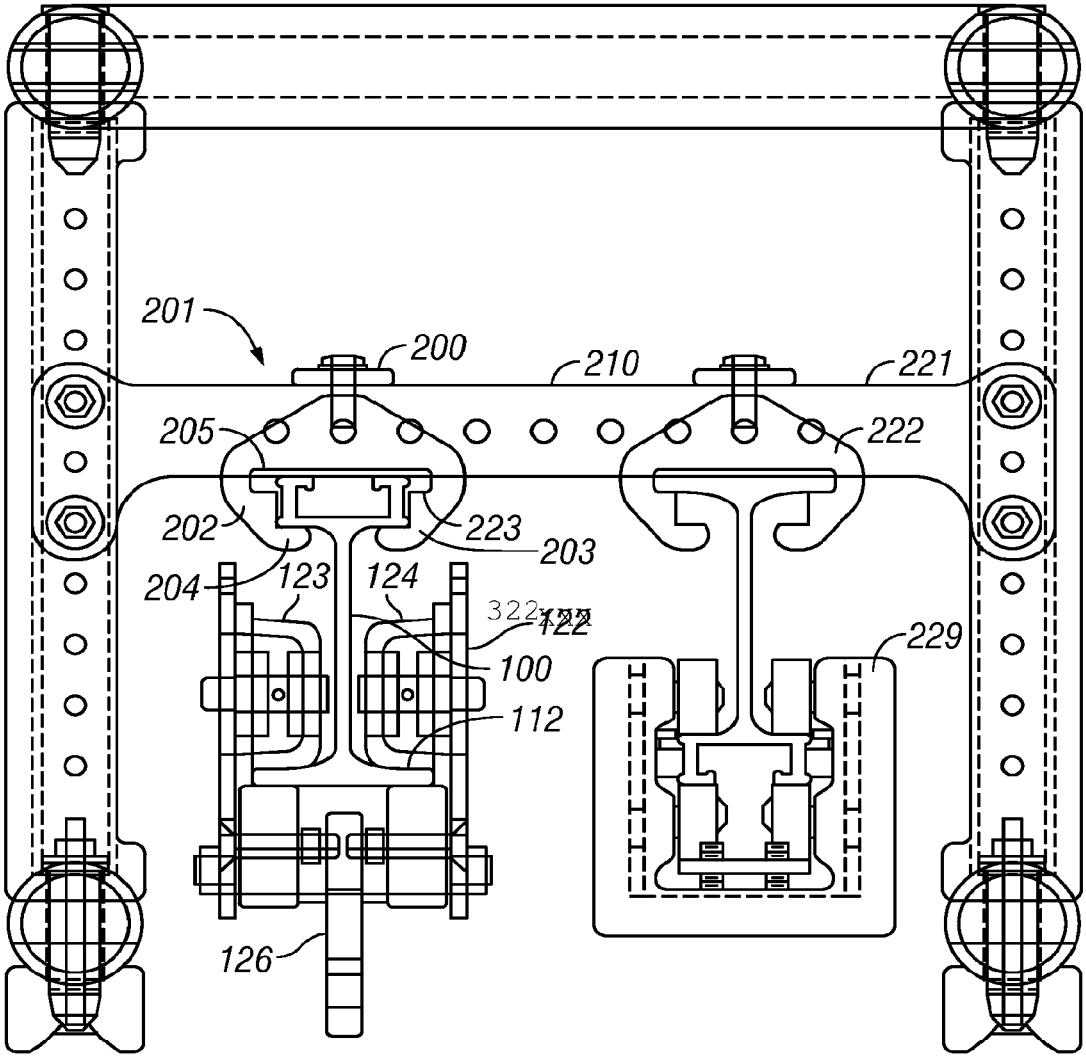
FIG. 2 shows an application of the different extrusions, and a special clamp for the extrusions.

FIG. 2 illustrates an embodiment showing how the extrusion 100 can be used. This embodiment holds the extrusion using a clamp that has two different sets of surfaces for the different sides of the extrusion.

In the FIG. 2 embodiment, a truss 210 includes a clamp 200. This embodiment uses a special clamp which can be configured to hold either side of the extrusion 100. The extrusion 201 on the left side of the drawing is being held by the cavity side of the extrusion, with the I-beam side of the extrusion holding the load. In this embodiment, the I beam surfaces 112 face upward. An I-beam trolley 322, of the type described in our copending application No. 61/176,692, filed May 8, 2009, rides along those surfaces. The I-beam trolley 322 includes spaced wheels 123, 124. Those wheels press against, and allow movement relative to, the tangent point of surface 112 of the I-beam side. The I-beam trolley 322 also includes a connection portion 126 at its lowermost part, which can hold something to ride against the I-beam e.g. a piece of scenery or the like.

The clamp 200 holds either side of the extrusion using two movable side pieces 202, 203. Each movable side piece includes dual surfaces, including the first surface 204 which is a first distance from the stop surface 205, and the second surface 223. The distance between the surfaces 204 and 205 is substantially equal to the height between the bottom of most surface 144 of the cavity, and the topmost surface 145 of the cavity. Therefore, the clamp can be tightened to the position shown in 201 to hold against the two surfaces 144,145 of the cavity, on both sides 202, 203. The clamp can also be loosened to open between the first side 202 and the second side 203, to allow removing the extrusion.

On the second side 221 of the drawing in FIG. 2, the clamp 222 is holding the I-beam side of the extrusion using the second surfaces 223. The second set of surfaces are spaced farther apart than the first set of surfaces 204 to accommodate the longer outer extent of the I beam side. The second set of surfaces are also closer to the stop surface 205 than that first set of surfaces 204. The distance between the top surface of the I-beam 111, and the riding surface of the I-beam 112 sets the distance between the stop surface 205 and the second surface 223. Therefore, when the I-beam side of the beam is placed within the clamp as shown in 222, the I-beam surfaces are held within a different portion of the clamp against different surfaces than those that hold the clamp surfaces. This allows the I-beam side to be held by the same clamp that can hold the cavity side.

In the embodiment, a trolley or scenery dog such as 229 is held on the cavity side on the side 221, as shown.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example, the embodiment shows a very specific form factor, but other form factors can also be used.

Also, the inventor intends that only those claims which use the words "means for" are intended to be interpreted under 35 USC 112, sixth paragraph. Moreover, no limitations from the specification are intended to be read into any claims, unless those limitations are expressly included in the claims.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A support device, comprising an extrusion, having an I-beam portion at a first side of the extrusion, and an open cavity portion which forms inner surfaces at a second side of the extrusion, said open cavity portion having inner surfaces, defining sidewalls spaced by a first distance, and an opening to said cavity with surfaces that are spaced by a second distance smaller than said first distance, thereby partially closing the opening to the cavity and forming a captive portion, where said I beam portion and said open cavity portion each extend across substantially an entire length of the support device.

2. A device as in claim 1, further comprising first connection portions at the first side, and second connection portions at the second side.

3. A device as in claim 1, further comprising first surfaces on the I-beam portion which are adapted to support a device on said surfaces, and second surfaces on the cavity portion which hold a different device on said surfaces.

4. A device as in claim 1, further comprising a captive nut, held within said open cavity portion, between said sidewalls of said cavity portion, in a way that prevents said nut from rotating inside said cavity portion.

5. A support device, comprising an extrusion, having a first shape at a first side of the extrusion, said first shape having open outer ends defining first surfaces along which a device can be supported to move along said first surfaces, said first surfaces defined by outer edge surfaces of the first shape;

and having a second shape at a second side of the extrusion, said second shape having second surfaces defining a cavity along which a device can be supported to move along said second surfaces, said surfaces defined by said inner surfaces, said second shape, defining an open cavity portion which forms inner surfaces at a second side of the extrusion, where said first shape portion and said open cavity portion each extend across substantially an entire length of the support device.

6. A device as in claim 5, wherein said second surfaces are formed by sidewalls spaced by a first distance, and an opening to said cavity with surfaces that are spaced by a second distance smaller than said first distance, thereby partially closing the opening to the cavity and forming a captive portion.

7. A device as in claim 5, further comprising first connection portions at the first side, and second connection portions at the second side.

8. A device as in claim 5, further comprising a captive nut, held within said open cavity portion, between said sidewalls of said cavity portion, in a way that prevents said nut from rotating inside said cavity portion.

* * * * *